US009171651B2

(12) United States Patent
Muro

(10) Patent No.: US 9,171,651 B2
(45) Date of Patent: Oct. 27, 2015

(54) FIXTURE FOR COMPONENT TO BE MOUNTED TO CIRCUIT BOARD

(75) Inventor: Takashi Muro, Makinohara (JP)

(73) Assignee: Yazaki Corporation, Tokyo (JP)

( * ) Notice: Subject to any disclaimer, the term of this patent is extended or adjusted under 35 U.S.C. 154(b) by 173 days.

(21) Appl. No.: 13/813,712

(22) PCT Filed: Aug. 1, 2011

(86) PCT No.: PCT/JP2011/067627

§ 371 (c)(1),
(2), (4) Date: Feb. 1, 2013

(87) PCT Pub. No.: WO2012/017996

PCT Pub. Date: Feb. 9, 2012

(65) Prior Publication Data

US 2013/0126211 A1 May 23, 2013

(30) Foreign Application Priority Data

Aug. 2, 2010 (JP) ..... 2010-173762

(51) Int. Cl.
*H01R 12/77* (2011.01)
*H01R 12/72* (2011.01)
(Continued)

(52) U.S. Cl.
CPC ..... *H01B 1/00* (2013.01); *H01R 12/707* (2013.01); *H01R 12/724* (2013.01); *H01R 12/77* (2013.01); *H01R 13/03* (2013.01); *H01R 13/60* (2013.01)

(58) Field of Classification Search
CPC ..... H01R 13/60; H01R 12/77; H01R 12/724; H01R 12/727
USPC ..... 174/126.1, 126.3
See application file for complete search history.

(56) References Cited

U.S. PATENT DOCUMENTS 6,280,248 B1 8/2001 Mitra
6,413,117 B1 * 7/2002 Annerino et al. ..... 439/500
(Continued)

FOREIGN PATENT DOCUMENTS

CN 1755998 A 4/2006
CN 101032057 A 9/2007
(Continued)

OTHER PUBLICATIONS

International Search Report (PCT/ISA/210), dated Sep. 20, 2011, issued by the International Searching Authority in counterpart International Patent Application No. PCT/JP2011/067627.
(Continued)

*Primary Examiner* — Jeremy C Norris
*Assistant Examiner* — Nathan Milakovich
(74) *Attorney, Agent, or Firm* — Sughrue Mion, PLLC

(57) ABSTRACT

An object is to provide a fixture for a component to be mounted on a circuit board which is easily manufactured and can exhibit good solderability and high whisker resistance. In a fixture which includes a solder joint plate part 11 that can be fixed on a surface of a circuit board by soldering using solder cream, and a component fixing part 12 that can be fixed to a component configured to be mounted on the circuit board, and in which Sn plating is performed at least on a solder joint surface of the solder joint plate part, the solder joint plate part 11 is divided into a plurality of long-plate-like solder joint pieces 13, and on both sides of each of the long-plate-like solder joint pieces 13, wing-like joint feet are provided to protrude through bent flexible parts 16, and the lower surface of each of the joint feet 15 becomes a solder joint surface 18 to be joined with the surface of the circuit board by solder cream.

1 Claim, 3 Drawing Sheets

(51) Int. Cl.

| | |
|---|---|
| ***H01R 13/60*** | (2006.01) |
| ***H01B 1/00*** | (2006.01) |
| ***H01R 12/70*** | (2011.01) |
| *H01R 13/03* | (2006.01) |

(56) References Cited

U.S. PATENT DOCUMENTS

| | | | | |
|---|---|---|---|---|
| 6,540,540 | B1 * | 4/2003 | Tobey | 439/327 |
| 6,638,106 | B1 * | 10/2003 | Wu | 439/567 |
| 7,094,100 | B2 * | 8/2006 | Nakano | 439/570 |
| 7,108,923 | B1 * | 9/2006 | Ito et al. | 428/675 |
| 2002/0072263 | A1 | 6/2002 | Fumikura | |
| 2005/0227534 | A1 | 10/2005 | Nakano | |
| 2006/0068620 | A1 | 3/2006 | Okamura et al. | |
| 2006/0121780 | A1 | 6/2006 | Nakano | |
| 2006/0255092 | A1 * | 11/2006 | Chen | 228/39 |
| 2008/0085616 | A1 | 4/2008 | Hirai et al. | |
| 2009/0227127 | A1 * | 9/2009 | Kim et al. | 439/78 |
| 2012/0135641 | A1 * | 5/2012 | Okuyama et al. | 439/626 |
| 2012/0193139 | A1 * | 8/2012 | Okuyama et al. | 174/551 |
| 2015/0083478 | A1 * | 3/2015 | Endo et al. | 174/261 |

FOREIGN PATENT DOCUMENTS

| | | | |
|---|---|---|---|
| JP | 58-178282 | U | 11/1983 |
| JP | 62-190371 | U | 12/1987 |
| JP | 7-161397 | A | 6/1995 |
| JP | 7-335342 | A | 12/1995 |
| JP | 8-512424 | A | 12/1996 |
| JP | 11-26049 | A | 1/1999 |
| JP | 2002-237342 | A | 8/2002 |
| JP | 2005-302523 | A | 10/2005 |
| JP | 2007-305542 | A | 11/2007 |
| JP | 2009-266499 | A | 11/2009 |

OTHER PUBLICATIONS

Written Opinion (PCT/ISA/237), dated Sep. 20, 2011, issued by the International Searching Authority in counterpart International Patent Application No. PCT/JP2011/067627.

Communication from the Korean Intellectual Property Office dated Feb. 13, 2014 in a counterpart Korean application No. 10-2013-7002849.

Office Action dated Sep. 1, 2014, issued by the State Intellectual Property Office of the People's Republic of China in counterpart Chinese Application No. 201180037769.5.

Office Action dated Sep. 30, 2014, issued by the Japanese Patent Office in counterpart Japanese Application No. 2010-173762.

Communication dated Apr. 24, 2015 issued by the State Intellectual Property Office of the People's Republic of China in counterpart Chinese Patent Application No. 201180037769.5.

* cited by examiner

FIXTURE FOR COMPONENT TO BE MOUNTED TO CIRCUIT BOARD

TECHNICAL FIELD

The present invention relates to a fixture for fixing a component such as a board-mounted connector to a circuit board by soldering.

BACKGROUND ART

For example, the surfaces of a fixture for fixing a board-mounted connector on a circuit board by soldering are generally subjected to tin (Sn) plating for improving solderability. However, it is being pointed out that in a case of soldering the fixture plated with Sn onto a circuit board, there is a fear that internal stress or external stress will act on a solder joint part, whereby needle-like crystals called whiskers will be generated, and the whiskers will cause short-circuiting between components around the fixture.

It is known that internal stress or external stress acting on an Sn plating layer as described above is related to generation of whiskers, and in Patent Document 1, there is disclosed a technology of forming recesses having depths, which are 0.4 times to 1.0 time the thickness of an Sn plating layer, in the plating layer, so as to relieve internal stress or external stress acting on the Sn plating layer by the recesses, thereby suppressing generation of whiskers.

CITATION LIST

Patent Document

Patent Document 1: Japanese Patent Application Laid-Open No. 2009-266499

DISCLOSURE OF THE INVENTION

Problems that the Invention is to Solve

However, like the technology disclosed in Patent Document 1, in order to form recesses having 0.4 times to 1.0 time the thickness of the Sn plating layer in the plating layer, considerably strict working accuracy is required, and it is not easy to manufacture a member for which rough accuracy is enough, such as a fixture.

Therefore, an object of the present invention is related to solving the above-mentioned problem, and is to provide a fixture for a component to be mounted on a circuit board which is easily manufactured without requiring particularly strict working accuracy and can exhibit good solderability and high whisker resistance.

Means for Solving the Problems

The above-mentioned object of the present invention can be achieved by the following configuration.

(1) A fixture for a component to be mounted on a circuit board, comprising:

a solder joint plate part to be fixed on a surface of a circuit board by soldering using solder cream; and a component fixing part fixed to a component to be mounted on the circuit board;

wherein Sn plating is performed at least on a solder joint surface of the solder joint plate part;

the solder joint plate part is divided into a plurality of long-plate-like solder joint pieces;

on both sides of each of the long-plate-like solder joint pieces, wing-like joint feet are provided to protrude through bent flexible parts; and a lower surface of each of the joint feet becomes the solder joint surface to be joined with the surface of the circuit board by the solder cream.

According to the fixture having the above-mentioned configuration (1), there are the flexible parts in the base portions of the joint feet serving as solder joint parts, and the flexible parts are elastically deformed, whereby an external force transmitted from a connector or stress based on thermal deformation of the fixture is distributed and absorbed. Therefore, it becomes possible to reduce whiskers which are generated at the fixture due to external stress or internal stress.

Also, a number of joint feet are soldered onto the circuit board, whereby the solder joint surface is distributed. Therefore, it becomes easy for reflow heat to be transferred to solder and the solderability is improved. Further, since this fixture is configured only by dividing the solder joint plate part into the plurality of solder joint pieces, and providing the plurality of joint feet to protrude through the flexible parts, manufacturing is simple, and it is possible to suppress an increase in cost.

BEST MODE FOR CARRYING OUT THE INVENTION

Hereinafter, an embodiment of the present invention will be described with reference to the drawings.

Figure 1A:
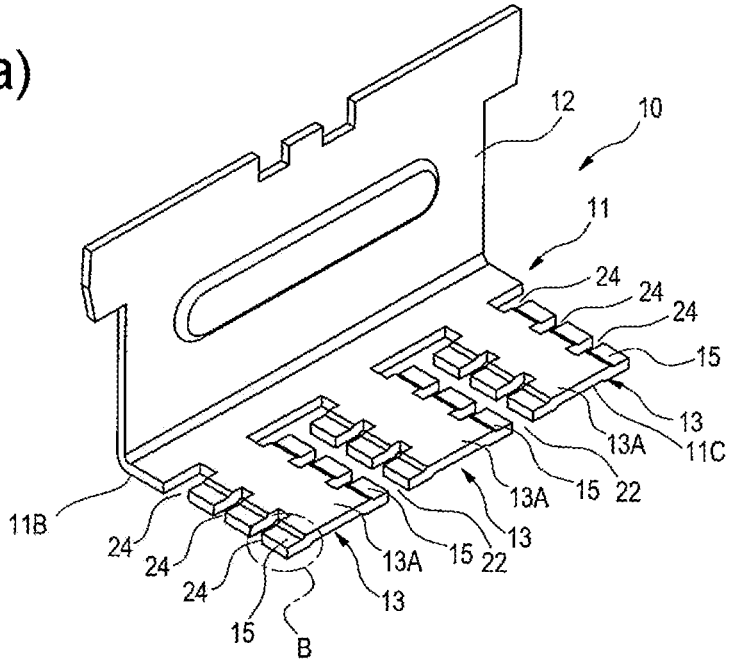
FIG. 1 is a view of the configuration of a fixture of an embodiment of the present invention, FIG. 1(*a*) is a perspective view as seen obliquely from the above, and FIG. 1(*b*) is an enlarged view as a part "'B" of FIG. 1(*a*) is seen from the front.
Figure 1B:
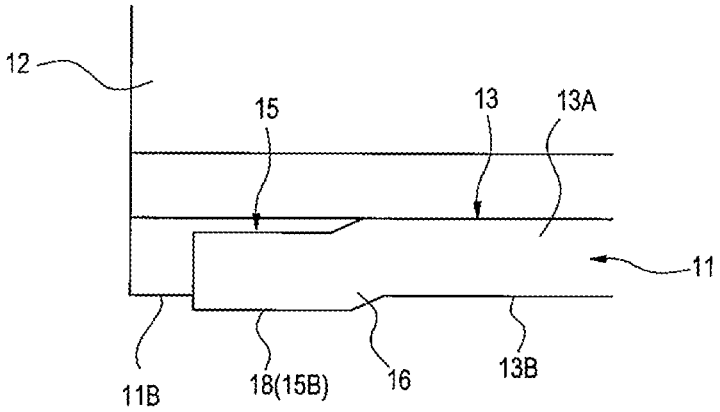
Figure 2A:
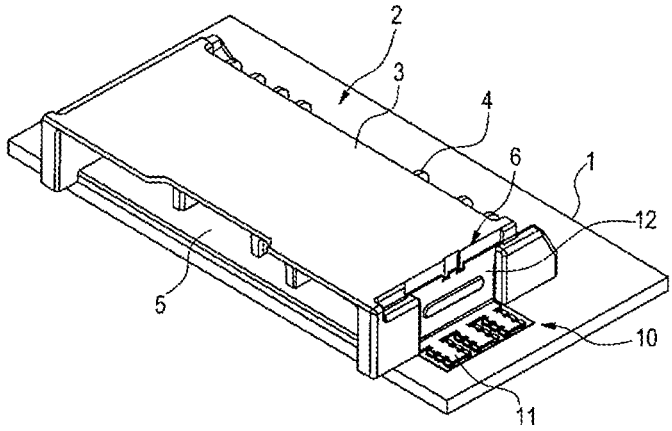
FIG. 2 is a view illustrating a state where the fixture of the embodiment of the present invention has been used to fix a board-mounted connector on a circuit board, FIG. 2(*a*) is a perspective view of the whole, and FIG. 2(*b*) is an enlarged perspective view of its main part.
Figure 2B:
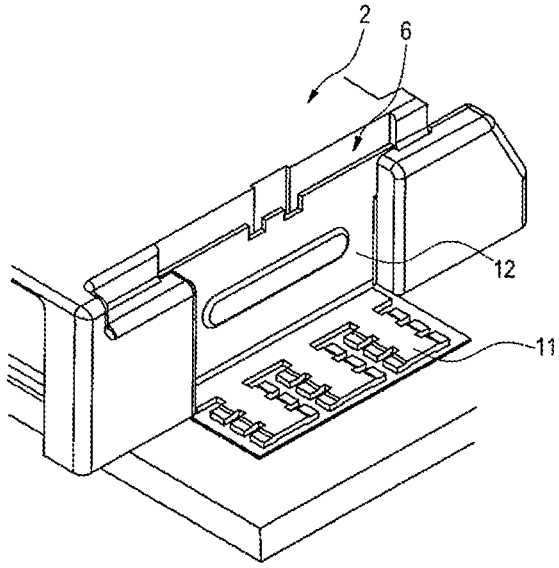
Figure 3:
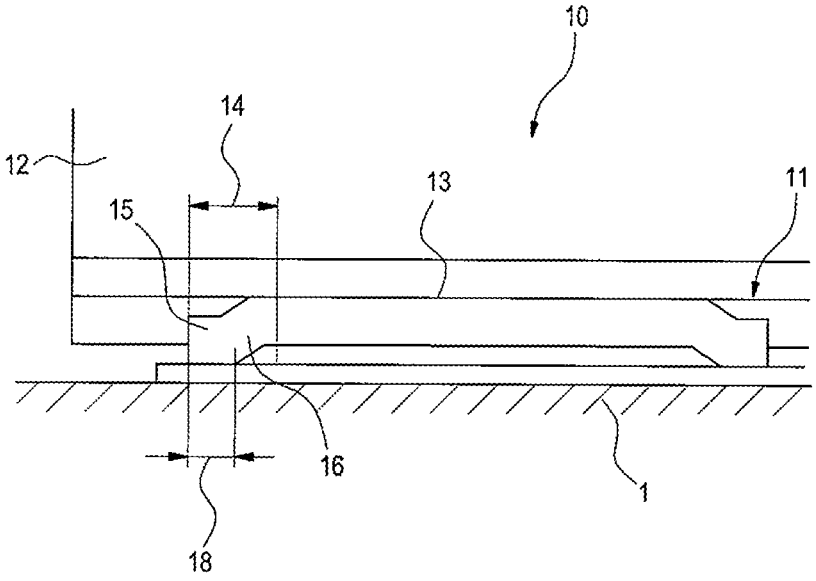
FIG. 3 is an enlarged front view illustrating a joint state of one solder joint piece of the same fixture.

FIG. 1 is a view of the configuration of a fixture of an embodiment, FIG. 1(*a*) is a perspective view as seen obliquely from the above, and FIG. 1(*b*) is an enlarged view as a part "'B" of FIG. 1(*a*) is seen from the front. FIG. 2 is a view illustrating a state where the fixture of has been used to fix a board-mounted connector on a circuit board, FIG. 2(*a*) is a perspective view of the whole, and FIG. 2(*b*) is an enlarged perspective view of its main part. FIG. 3 is an enlarged front view illustrating a joint state of one solder joint piece of the same fixture.

As shown in FIG. 1(*a*), FIG. 1(*b*), FIG. 2(*a*), and FIG. 2(*b*), a fixture 10 of this embodiment is a bent plate-like fixture having an L shaped section which can be attached to both side portions of a board-mounted connector 2 to be mounted on a circuit board 1 (a component to be mounted on a circuit board), and includes a solder joint plate part 11 which can be fixed to a surface of the circuit board 1 by using solder cream, and a component fixing part 12 that can be fit and fixed in fixture mounting portions 6 of both side portions of a connector housing 3 of the connector 2.

The connector 2 is configured by mounting a number of terminals 4 on the rear wall portion of the connector housing 3 having a fitting hole 5 for a counterpart connector formed at the front surface, the front end of each terminal 4 is exposed inside the fitting hole 5 of the connector housing 3, and the rear foot portion of each terminal 4 extending toward the rear side of the connector housing 3 is connected to a circuit conductor of the circuit board 1, whereby the connector 2 is mounted on the circuit board 1.

That does not result in sufficient attachment strength, and thus solder joint surfaces 11B of the solder joint plate parts 11 of fixtures 10 attached to both side portions of the connector housing 3 are soldered on the circuit board 1 by using solder cream, thereby being fixed on the circuit board 1. To this end, Sn plating is performed at least on the solder joint surfaces 11B of the solder joint plate parts 11.

In this case, as shown in FIGS. 1(*a*) and 1(*b*), the solder joint plate part 11 of the fixture 10 has slits 22 formed from an end edge 11C far from the component fixing part 12 to a position close to the component fixing part 12 such that the solder joint plate part 11 is divided into a plurality of (three in the case of the example shown in the drawings) long-plate-like solder joint pieces 13.

Also, at both side edges of each long-plate-like solder joint piece 13, cut portions 24 having a predetermined length in a direction perpendicular to the both side edges are formed, whereby a plurality of (three in the case of the example shown in the drawings) joint feet 15 is provided. The base portions of the joint feet 15 are connected to main body portions 13A (portions with no cuts) of the solder joint pieces 13 through flexible parts 16 bent obliquely downward, and joint feet 15 forming a pair with the main body portion 13A of a solder joint piece 13 protrude in a wing form from the main body portion 13A of the solder joint piece 13.

Further, the lower surfaces 15B of the individual joint feet 15 set below the lower surfaces 13B of the main body portions 13A of the solder joint pieces 13 are regarded as solder joint surfaces 18 to be joined on the surface of the circuit board 1 by solder cream. In FIG. 3, a dimension shown by reference numeral '24' represents the length of a cut 24, and a dimension shown by reference numeral '18' represents the length of a solder joint surface 18.

In a case of using this fixture 10 to mount the connector 2 on the circuit board 1, solder cream is applied on portions for mounting the solder joint plate parts 11 of the fixture 10, and the solder joint plate parts 11 of the fixture 10 are mounted thereon and is passed through a reflow bath, whereby the solder joint plate parts 11 are joined on the land of the circuit board 1. At this time, there are the flexible parts 16 at the base portions of the joint feet 15 serving as solder joint parts, and the flexible parts 16 are elastically deformed, whereby an external force transmitted from the connector 2 or stress based on thermal deformation of the fixture 10 is distributed and absorbed. Therefore, it becomes possible to reduce whiskers which are generated at the fixture 10 due to external stress or internal stress.

Also, a number of joint feet 15 are soldered onto the circuit board 1, whereby the solder joint surface is distributed so it becomes easy for reflow heat to be transferred to solder and the solderability is improved. Therefore, it is possible to prevent short-circuiting between peripheral components and the fixture 10 attributable to whiskers. Further, since this fixture 10 is configured only by dividing the solder joint plate part 11 into the plurality of solder joint pieces 13, and providing the plurality of joint feet 15 to protrude through the flexible parts 16, manufacturing is simple, and it is possible to suppress an increase in cost.

The present invention is not limited to the above-mentioned embodiment, but can be appropriately modified and improved. Further, the material, shape, dimensions, number, disposition place, and the like of each component of the above-mentioned embodiment are arbitrary as long as the present invention can be achieved, and are not limited.

For example, the number of solder joint pieces 13 may be any number, and the number of joint feet 15 may be any number.

Although the present invention has been described in detail with reference to the specific embodiment, it is apparent to those skilled in the art that it is possible to add various changes or modifications without departing from the sprit and scope of the present invention.

This application is based on Japanese Patent Application (Application No. 2010-173762) filed on Aug. 2, 2010 whose contents are incorporated herein by reference.

INDUSTRIAL APPLICABILITY

According to the present invention, it is possible to exhibit good solderability and high whisker resistance, without requiring particularly strict working accuracy.

DESCRIPTION OF REFERENCE NUMERALS AND SYMBOLS

1 Circuit board
2 Connector (component configured to be mounted on circuit board)
10 Fixture
11 Solder joint plate part
12 Component fixing part
13 Solder joint piece
15 Joint foot
16 Flexible part
18 Solder joint surface

The invention claimed is:

1. A fixture for a component to be mounted on a circuit board, comprising:

a solder joint plate part to be fixed on a surface of a circuit board by soldering using solder cream; and a component fixing part fixed to a component to be mounted on the circuit board;

wherein Sn plating is performed at least on a solder joint surface of the solder joint plate part;

the solder joint plate part includes slits formed from an end edge of the component fixing part to a position close to the component fixing part so that the solder joint plate part is divided into a plurality of long-plate-like solder joint pieces separated by the slits and extending in a first direction;

cut portions extending in a second direction perpendicular to the first direction are formed on both side edges, so that wing-like joint feet are provided which extend in the second direction, said joint feet being connected to the solder joint pieces through flexible parts which are bent in a thickness direction perpendicular to the first and second directions; and a lower surface of each of the joint feet becomes the solder joint surface to be joined with the surface of the circuit board by the solder cream.

* * * * *